US005585899A

United States Patent [19]

Palumbo et al.

[11] Patent Number: 5,585,899

[45] Date of Patent: Dec. 17, 1996

[54] MULTICONTAINER TONER DISPENSING APPARATUS

[75] Inventors: Kenneth S. Palumbo, Irondequoit; Robert A. Pictor, Webster, both of N.Y.

[73] Assignee: Xerox Corporation, Stamford, Conn.

[21] Appl. No.: 597,486

[22] Filed: Feb. 2, 1996

[51] Int. Cl.[6] ..... G03G 15/06

[52] U.S. Cl. ..... 355/246; 355/208; 355/260

[58] Field of Search ..... 355/208, 245, 355/246, 260

[56] References Cited

U.S. PATENT DOCUMENTS 5,077,584 12/1991 Tanaka et al. ..... 355/260

5,258,248 11/1993 Tokuhashi et al. ..... 355/246 X 5,329,340 7/1994 Fukuchi et al. ..... 355/246

*Primary Examiner*—Arthur T. Grimley

*Assistant Examiner*—Sophia S. Chen

*Attorney, Agent, or Firm*—H. Fleischer; J. E. Beck; R. Zibelli

[57] ABSTRACT

An apparatus for replenishing toner in a developer unit has a plurality of toner discharge units. A selected discharge unit is energized to dispense toner into the developer unit with the other discharge units being de-energized. After the energized discharge unit is substantially depleted of toner, another toner discharge unit is energized. The depleted toner discharge unit is removed and replaced with a new toner discharge unit.

21 Claims, 3 Drawing Sheets

MULTICONTAINER TONER DISPENSING APPARATUS

This invention relates generally to a developer apparatus. More specifically, the invention relates to a developer unit having unused toner containers which can be loaded while another toner container is discharging toner into the developer unit.

In a typical electrophotographic printing process, a photoconductive member is electrostatically charged, and then exposed to a light pattern of an original image to selectively discharge the surface in accordance therewith. The resulting pattern of charged and discharged areas on the photoconductive member form an electrostatic charge pattern known as a latent image. The latent image is developed by contacting it with a dry or liquid marking material having a carrier and toner. The toner is attracted to the image areas and held thereon by the electrostatic charge on the photoconductive member. Thus, a toner image is produced in conformity with a light image of the original being reproduced. The toner image is transferred to a copy sheet, and the image affixed thereto to form a permanent record of the image to be reproduced. Subsequent to development, excess toner left on the photoconductive member is cleaned from its surface. The process is useful for copying from an original document with a light lens system as well as for printing electronically generated or stored originals with a RIS (Raster Input Scanner)/ROS (Raster Output Scanner) system.

This generally describes a typical black and white or single color electrophotographic printing process. The approach utilized for multicolor electrophotographic printing is substantially identical. However, instead of forming a single latent image on the photoconductive member, multiple latent images corresponding to different color separations are sequentially developed thereon. Each single color latent image is developed with toner complimentary thereto. This process is repeated for each of the differently colored images with a respective toner of a complimentary color. Thereafter, each single color toner image is transferred to the copy sheet in superimposed registration with the prior toner image, creating a multi-layered toner image. This multi-layered toner image is permanently affixed to the copy sheet to form a finished color copy.

A common technique for development uses a two-component developer material of toner particles adhering triboelectrically to larger carrier beads. When the developer material is placed in a magnetic field, the carrier beads with the toner particles thereon form a magnetic brush. The toner particles are attracted from the carrier beads to develop the latent image.

Another development technique involves a single-component developer, that is, a developer which consists entirely of toner. Instead of using magnetic carrier beads to form a magnetic brush, magnetized toner particles adhere directly to a developer roll. The toner particles are attracted from the carrier beads to develop the latent image.

As dry or liquid developer material is consumed during printing, it must be replaced. Hence, printers have a container from which fresh developer material is dispensed into the machine. When the container emptied, developer material was originally replaced by pouring new material from separate bottles into the container. Thereafter, replaceable cartridges were supplied to avoid problems associated with spillage. In both cases, replacing the developer material occurred while the machine operation was interrupted. However, for high volume printing, it is desirable to replenish the developer without having to shut the machine down.

In accordance with one aspect of the invention, there is provided an apparatus for replenishing toner in a developer unit. The apparatus includes a first toner dispenser, in communication with the developer unit, to discharge toner into the developer unit. A second toner dispenser, in communication with the developer unit, is energized in response to the first toner dispenser being substantially depleted of toner so as to discharge toner into the developer unit.

In accordance with another aspect of the invention, there is provided a printing machine of the type having a developer unit adapted to develop a latent image on an image receiving member with toner. The improvement includes a first toner discharge unit, in communication with the developer unit, to discharge toner into the developer unit. A second toner discharge unit, in communication with the developer unit, is energized in response to the first toner discharge unit being substantially depleted of toner so as to discharge toner into the developer unit.

In accordance with still another aspect of the invention, there is provided a method of dispensing toner into a developer unit. The method includes: activating a first toner dispenser to discharge toner into the developer unit, sensing the quantity of toner remaining in the first toner dispenser and generating a signal indicative thereof, and activating a second toner dispenser, in response to the signal indicating that the first toner dispenser is substantially depleted of toner, to discharge toner into the developer unit.

While the present invention will hereinafter be described in connection with a preferred embodiment thereof, it will be understood that it is not intended to limit the invention to that embodiment. On the contrary, it is intended to cover all alternatives, modifications and equivalents that may be included within the spirit and scope of the invention as defined by the appended claims.

Figure 1:
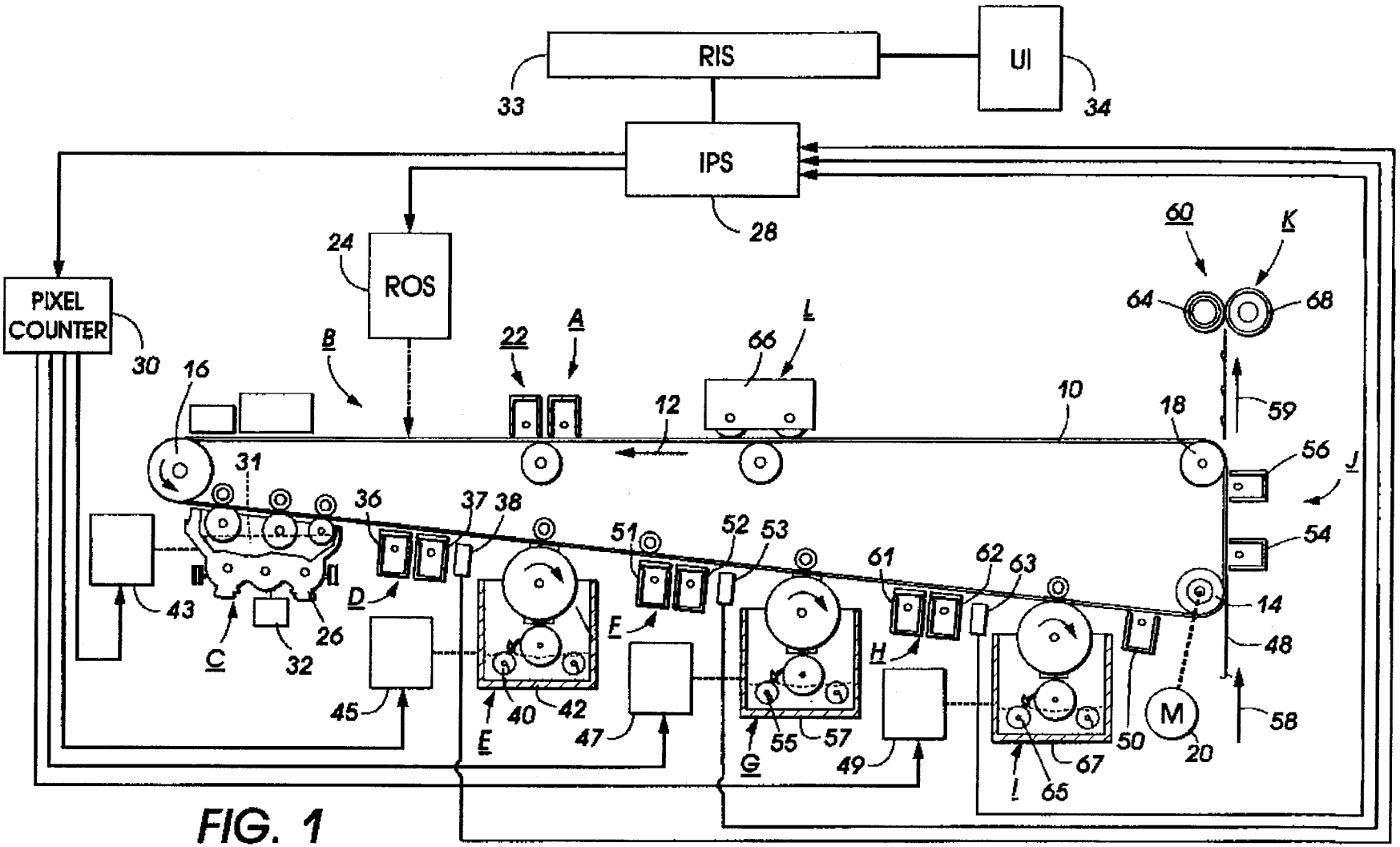
FIG. 1 is an elevational view showing an illustrative printing machine incorporating the multicontainer toner dispensing system of the present invention therein.

FIG. 1 schematically depicts the various elements of an illustrative color electrophotographic printing machine incorporating the multicontainer toner dispenser of the present invention therein. It will become evident from the following discussion that the multicontainer toner dispensing system is equally well suited for use in a wide variety of printing machines and is not necessarily limited in its application to the particular embodiment depicted herein.

Turning now to FIG. 1, the printing machine employs a photoreceptor 10 in the form of a belt having a photoconductive surface layer on an electroconductive substrate. Photoreceptor 10 is driven by motor 20 and moves along a path indicated by arrow 12 around rollers 14, 18, and 16.

Initially, photoreceptor 10 passes through charging station A where it is charged to a relatively high uniform potential by corona generating device 22. For purposes of this example, photoreceptor 10 is negatively charged. However, it is understood that a positively charged photoreceptor may be used by reversing the charge levels, toner polarities, and other relevant regions or devices involved in the color image formation process.

Next, the charged portion of photoreceptor 10 is advanced to an imaging station B where it is exposed by imaging device 24 and discharged to form a latent image in accordance with the output therefrom. Imaging device 24 is a Raster Output Scanner (ROS) that creates an image in a series of horizontal scan lines having a certain number of pixels per inch. It may include a laser with rotating polygon mirror blocks and a suitable modulator, or in lieu thereof, a light emitting diode array (LED) write bar. Imaging device 24 is controlled by the output from an image generator 28 of an electronic subsystem (ESS) which prepares and manages the image data flow between a computer and imaging devices 24, 38, 53, and 63. The FSS is the control system for these imaging devices and may be a self-contained, dedicated minicomputer. Thereafter, the latent image on photoreceptor 10 is advanced to development station C.

One skilled in the art will appreciate that a light lens system may be used for copying as well as a RIS-33-ROS system. UI 34 is connected to RIS 33 with a light lens system, an original document may be placed face down on a transparent platen. Lamps emit light rays that are reflected by the document and transmitted through a lens to form a light image thereof. The lens focuses the light image onto the charged portion of the photoreceptor to selectively dissipate the charge thereon. This records a latent image on the photoreceptor corresponding to the informational areas contained in the original document disposed on the platen.

The latent image on photoreceptor 10 is advanced to a first development station C, where a magnetic brush developer unit 26 advances developer material 31 into contact with the latent image. Developer unit 26 has a plurality of magnetic brush roller members that transport negatively charged black toner material 31 to the latent image for development thereof. A power supply 32 electrically biases developer unit 26.

At recharging station D, a pair of corona recharge devices 36 and 37 are employed for adjusting the voltage level of both the toned and untoned areas on photoreceptor 10 to a uniform level. A power supply (not shown) is coupled to each of the electrodes of corona recharge devices 36 and 37. While recharge devices 36 and 37 eliminate the voltage difference between the toned and untoned areas, they also function to reduce the level of residual charge remaining on the previously toned areas so that subsequent development of different color toner images is effected across a uniform development field.

Imaging device 38 records a second electrostatic latent image on photoreceptor 10. A negatively charged developer material 40, for example, yellow toner, develops the second latent image. The toner is contained in a developer unit 42 disposed at a second developer station E. A donor roll in developer housing 42 transports the toner to the second latent image. A power supply (not shown) electrically biases the developer unit.

At a second recharging station F, corona recharge devices 51 and 52 uniformly adjust the voltage level between the toned and untoned areas of photoreceptor 10. The recharge devices 51 and 52 reduce the residual charge level remaining on the previously toned areas so that the subsequent development of a different color toner image is effected across a uniform development field.

A third latent image is recorded on photoreceptor 10 by imaging device 53. This image is developed using a third color toner 55 contained in a developer unit 57 disposed at a third developer station G. An example of a suitable third color toner is magenta. Suitable electrical biasing of the developer unit 57 is provided by a power supply (not shown).

At a third recharging station H, corona recharge devices 61 and 62 uniformly adjust the voltage level between the toned and untoned areas of photoreceptor 10. These recharge devices also function to reduce the level of residual charge remaining on the previously toned areas. In this manner, the subsequent development of a different color toner image is effected across a uniform development field.

A fourth latent image is recorded on photoreceptor 10 by imaging device 63. This image is developed, for example, using a cyan color toner 65 contained in developer unit 67 at a fourth developer station I. Suitable electrical biasing of the developer unit 67 is provided by a power supply (not shown).

The developer units 42, 57, and 67 are preferably of the type which do not interact, or are only marginally interactive with previously developed images. They may, for example, include: a DC jumping development system, a powder cloud development system, or a sparse, non-contacting magnetic brush development system wherein, each type is suitable for use in an image on image color development system.

As liquid or dry toner is consumed while developing the latent images at stations C, E, G, and I, additional toner is supplied to developer units 26, 42, 57, and 67 by a separate multicontainer toner dispensing system of the present invention. Specifically, developer unit 26 is replenished by toner dispensing system 43. Likewise, developer unit 42 is replenished by toner dispensing system 45. Developer unit 57 is replenished by toner dispensing system 47 and developer unit 67 is replenished by toner dispensing system 49. Each of the multicontainer toner dispensing systems 43, 45, 47, and 49 has a plurality of toner containers associated therewith to facilitate container changes "on the fly". This is an advantage during large print runs when volumes of copies are being made. As one container empties, it automatically triggers the dispensing of toner from another container so that the empty container can be replaced while the developer unit is running. In this way, the machine does not have to be shut down or interrupted during the print run to reload toner.

By using a variable rate toner dispenser algorithm contained in a pixel counter 30, the approximate amount of replenished toner may be calculated so that the amount of toner dispensed by each multicontainer toner dispensing system 43, 45, 47, and 49 can be increased as required by the job demand. Thus, more than one container, in each of the toner dispensing systems, can be actuated to deliver two or three times the amount of toner normally dispensed. A more detailed description of the multicontainer toner dispensing system will be presented hereinafter with reference to FIGS. 2 and 3.

After development of the fourth latent image, a pretransfer corotron member 50 conditions the toner for effective transfer to a copy sheet. Pretransfer corotron 50 charges all toner particles to a negative polarity required for proper transfer.

A sheet feeding apparatus (not shown) operates to advance a copy sheet, in the direction of arrow 58, to transfer station J. Copy sheet 48 is registered and deskewed before it arrives at transfer station J in synchronization with the toner image on the surface of photoreceptor 10.

Transfer Station J includes a transfer corona device 54 which sprays positive ions onto the backside of copy sheet 48. This attracts the negatively charged toner powder images from photoreceptor belt 10 to the sheet. A detack corona generator 56 is provided to strip the sheet from belt 10.

After transfer, the sheet continues to move, in the direction of arrow 59, to a conveyor (not shown) which advances the sheet to fusing station K. Fusing station K includes a fuser assembly 60 which permanently fixes the transferred color image to the copy sheet. Preferably, fuser assembly 60 comprises a heated fuser roller 64 and a backup or pressure roller 68. The copy sheet passes between fuser roller 64 and backup roller 68 with the toner powder image contacting fuser roller 64. In this manner, the toner powder images are permanently fixed to the sheet. After fusing, a chute (not shown) guides the advancing sheet to a finishing module (not shown).

Once the copy sheet is separated from photoreceptor 10, the residual toner carried on the photoreceptor surface is removed therefrom. The toner is removed at cleaning station L using a cleaning brush structure contained in a housing 66.

It is believed that the foregoing description is sufficient to illustrate the general operation of an electrophotographic printing machine. Referring now to the specific subject matter of the present invention, FIGS. 2 and 3 illustrate the structure and operation of the multicontainer toner dispensing system in greater detail.

Figure 2:
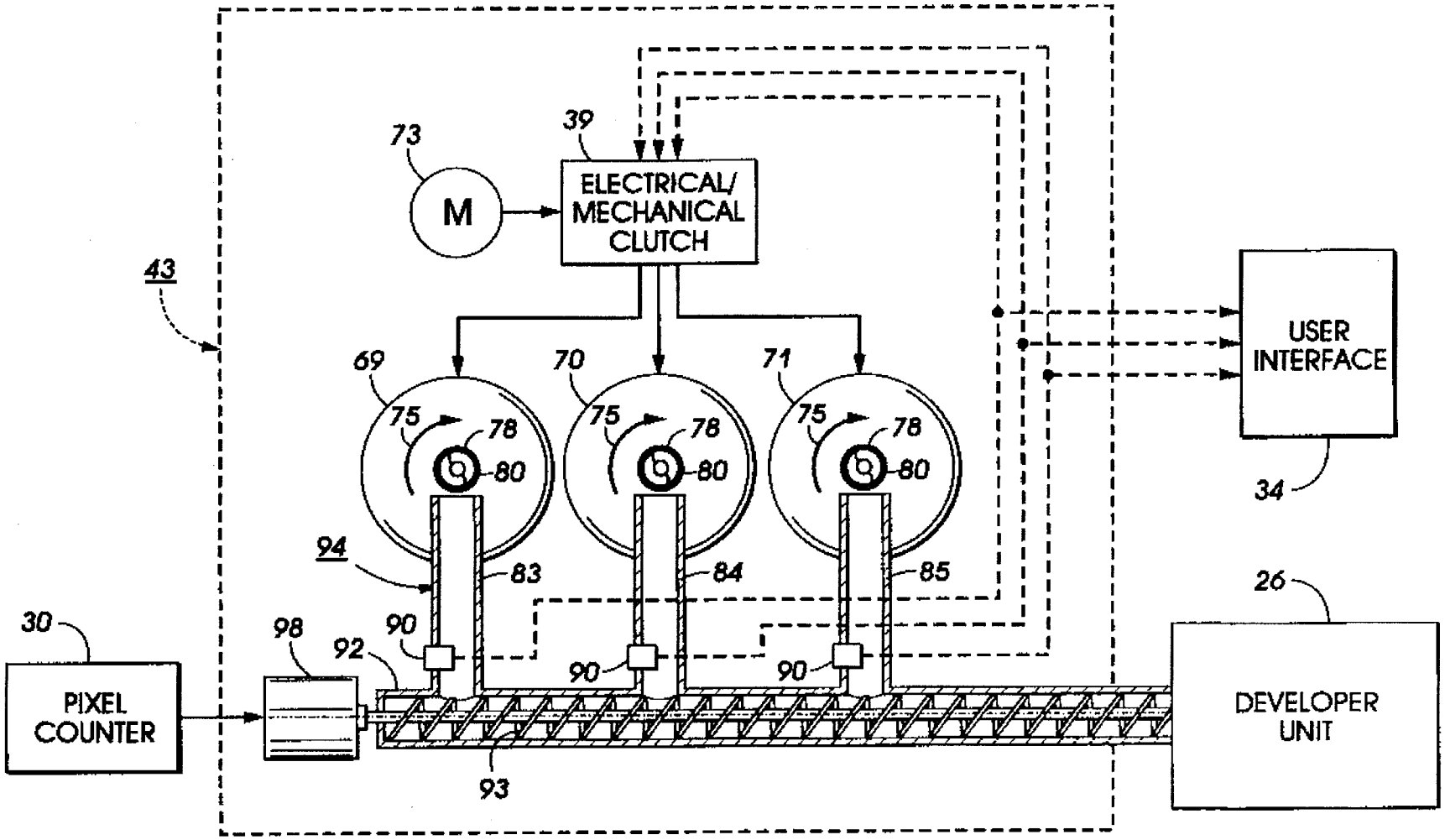
FIG. 2 is a schematic, elevational view depicting a plurality of toner dispensers used in each development system of the FIG. 1 printing machine.
Figure 3:
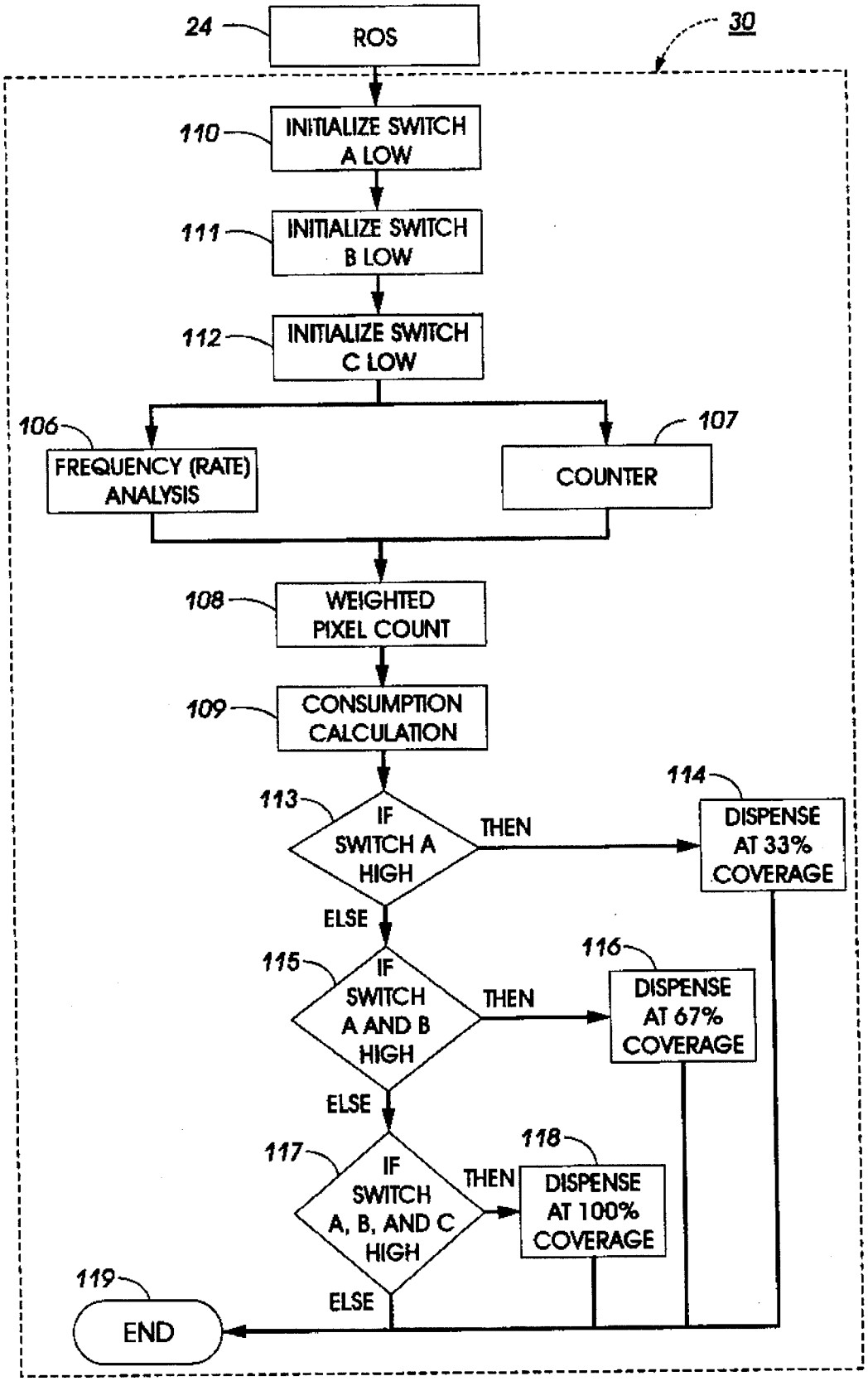
FIG. 3 is a flow chart of a pixel counting algorithm used in accordance with the present invention.

Turning now to FIG. 2, there is shown, in schematic form, a representation of a multicontainer toner dispensing system used in the FIG. 1 printing machine. Although FIG. 2 illustrates toner dispensing system 43, one skilled in the art will appreciate that FIG. 2 also represents the other toner dispensing systems shown in FIG. 1, namely 45, 47, and 49.

The multicontainer toner dispensing system 43, shown in FIG. 2, has a plurality of toner supply containers 69, 70, and 71 associated therewith. These containers dispense toner into a conduit 94 which, in turn feeds the toner to developer unit 26. Conduit 94 is comprised of a feed tube 92 having a plurality of intakes 83, 84, and 85 mounted thereon so that each supply container 69, 70 and 71 fills a corresponding intake. A common feed auger 93 is located in the feed tube 92 to receive the toner from intakes 83, 84, and 85, and move it along to developer unit 26.

Each of the intakes 83, 84, and 85 has an internal sensor 90 for monitoring the respective toner level therein. The sensors 90 may be of any suitable "on/off" type (i.e. opto-electrical, piezoelectric, and etc.). They are connected, as inputs, to the User Interface (UI) 34 and an electro-mechanical clutch assembly 39. The sensors 90 and the electro-mechanical clutch 39 function to selectively connect and disconnect supply containers 69, 70, and 71 with a drive motor 73.

The toner supply containers 69, 70, and 71 have separate outlets 78 and an auger 80 therein for moving toner from the containers to intakes 83, 84, or 85. When a respective sensor 90 detects a low toner level, clutch 39 is activated to connect the mating container with motor 73. The selected container is rotated by motor 73, in the direction of arrow 75, so that toner stored therein is transported by the auger 80 to the depleted intake. The toner fills the depleted intake until the sensor detects that the intake is sufficiently refilled so as to deactivate rotation of the selected container.

An exemplary sequence for dispensing toner to the common feed auger 93 is given below.

Initially toner is dispensed from container 69 and intake 83. Motor 73 and clutch 39 drive supply container 69 until the intake sensor (sensor 90 in intake 83) is satisfied of the presence of toner therein. As toner is drawn away, going below the sensor level, motor 73 is again energized to refill intake 83. The process is repeated until all the toner in container 69 is depleted after which, motor 73 runs continuously for a predetermined time. After running motor 73 without the intake 83 sensor monitoring any toner therein, the supply container 70 is engaged by clutch 39. Motor 73 drives container 70 until the intake sensor (sensor 90 in intake 84) is satisfied of the presence of toner in intake 84. An indicator on the User Interface (UI) 34 is then activated to indicate that container 69 is empty. The operator may now replace the empty container 69 with a new one having toner therein while the developer unit 26 is running.

Now toner is dispensed from container 70 and intake 84. As toner is drawn away, going below the sensor level (sensor 90 in intake 84), motor 73 is again energized to refill intake 84 The process repeats until all the toner in container 70 is depleted. Motor 73 runs continuously for another predetermined length of time. After running motor 73 without the intake 84 sensor monitoring any toner therein, supply container 71 is engaged by clutch 39. Motor 73 drives supply container 71 until the intake sensor (sensor 90 in intake 85) is satisfied of the presence of toner. Another indicator on the User Interface 34 is activated to indicate that container 70 is empty. As with container 69, the operator can now replace container 70 while the developer unit 26 is running.

Toner is finally dispensed from container 71 and intake 85. As toner is drawn away from intake 85, going below the sensor level (sensor 90 in intake 85), motor 73 is energized again to refill intake 85. The process, with intake 85, repeats until all the toner in container 71 is depleted. Motor 73 runs for another predetermined time interval and after running without the sensor monitoring any toner in intake 85, the new container 69 is engaged by clutch 39. Toner is again dispensed from container 69 and intake 83, while an indicator on the User Interface 34 indicates that container 71 is empty. The operator may now replace the empty container 71 with a new one having toner therein while the developer unit 26 is running.

While toner is dispensed to the common feed auger 93, a pixel counter 30 determines the rate by which toner is replenished to the developer unit 26. Pixel counter 30 actuates a variable speed motor 98 that drives the common feed auger 93. Motor 98 normally drives auger 93 to dispense at a low rate of approximately 20 grams of toner per minute for a 33 percent image area coverage. This low dispensing rate advantageously aids the "admix". Since too much toner added in too short a time may cause background problems on the output copies, the lower dispensing rate allows for a gentler handling of toner to prevent clumping. However when required, the dispensing rate can be doubled and tripled to achieve 67 and 100 percent area coverage. Thus, an output level from pixel counter 30 changes the rotational velocity of motor 98 to increase the amount of toner dispensed to developer unit 26 based upon the job demand.

In FIG. 3 there is shown a flow chart of the pixel counting algorithm contained in pixel counter 30. The imaging device 24 generates the image to be printed in the form of pixels. The pixel information is sent to pixel counter 30 which has three software switches A, B, and C that are initialized to a "Low" state at steps 110, 111, and 112. A frequency or rate analysis is performed on the pixel information at 106, to determine what type of image is being exposed on the photoreceptor. Simultaneously, the pixels are counted at 107. Outputs at 106 and 107 are used to assign a toner usage weighting factor to each image type thus, forming a weighted pixel count at 108. The weighted pixel count 108 provides for a toner consumption calculation at 109. The calculated amount is subtracted from an original or known amount of toner to indicate the remaining supply. The result, at step 109, is also compared to three predetermined values such that when the result of the calculation exceeds the first value, switch A changes to a "High" state. Similarly, when the result of the calculation exceeds the second value, switches A and B go "High". Finally, when the result exceeds the third value, switches A, B, and C are all "High ". Thereafter, the status of switch A is tested at 113. When switch A is "High" (Yes), the algorithm branches toward output 114 to dispense toner at the 33 percent image coverage rate before ending at 119. If the result of test 113 is false (Else), the status of switches A and B are tested at 115. When the condition of switches A and B are "High" (Yes), at test 115, the algorithm correspondingly branches to output 116. At output 116, the toner is dispensed at the 67 percent coverage rate before ending at 119. If the result of test 115 is false (Else), the status of switches A, B, and C are tested at 117. When the condition of switches A, B, and C are "High " (Yes), at test 117, the algorithm branches to output 118 and dispenses toner at the 100 percent image coverage rate before ending at 119. Otherwise, the alternative output condition (Else) simply proceeds to the end at step 119.

In recapitulation, the present invention is directed to a multicontainer toner dispensing system which can reload a developer unit from a plurality of toner containers while in an operating mode. In this manner, toner containers can be changed while the printing machine is operational.

It is, therefore, evident that there has been provided, in accordance with the present invention, a multicontainer toner dispensing system that fully satisfies the aims and advantages of the invention as hereinabove set forth. While the invention has been described in conjunction with a preferred embodiment thereof, it is evident that many alternatives, modifications, and variations may be apparent to those skilled in the art. Accordingly, it is intended to embrace all such alternatives, modifications, and variations which are within the spirit and broad scope of the appended claims.

We claim:

1. An apparatus for replenishing toner in a developer unit, including:

a stationarily mounted first toner dispenser, connected to the developer unit to discharge toner into the developer unit; and a stationarily mounted second toner dispenser, connected to the developer unit and being energized in response to said first toner dispenser being substantially depleted of toner, to discharge toner into the developer unit.

2. An apparatus according to claim 1, further including a sensor for detecting that said first toner dispenser is substantially depleted of toner and generating a signal indicative thereof to energize said second toner dispenser.

3. An apparatus according to claim 2, further including a third toner dispenser adapted to replace said first toner dispenser in response to the signal from said sensor, said first toner dispenser being removed from being in operative communication with said developer unit and being replaced by said third toner dispenser.

4. An apparatus for replenishing toner in a developer unit, including:

a first toner dispenser, in communication with the developer unit, to discharge toner into the developer unit;

a second toner dispenser in communication with the developer unit and being energized in response to said first toner dispenser being substantially depleted of toner, to discharge toner into the developer unit;

a sensor for detecting that said first toner dispenser is substantially depleted of toner and generating a signal indicative thereof to energize said second toner dispenser;

a third toner dispenser adapted to replace said first toner dispenser in response to the signal from said sensor, said first toner dispenser being removed from being in operative communication with said developer unit and being replaced by said third toner dispenser; and a conduit connecting said first toner dispenser and said second toner dispenser to the developer unit.

5. An apparatus according to claim 4, wherein said conduit includes:

a feed tube;

a first intake tube, connected to said feed tube, having said first toner dispenser removably coupled thereto, said third toner dispenser being coupled to said first intake tube in response to said first toner dispenser being de-coupled therefrom; and a second intake tube, connected to said feed tube, having said second toner dispenser removably coupled thereto.

6. An apparatus according to claim 5, wherein said sensor includes:

a first sensor mounted in said first intake tube to detect when said first toner dispenser is substantially depleted of toner; and a second sensor mounted in said second intake tube to detect when said second toner dispenser is substantially depleted of toner.

7. An apparatus according to claim 4, further including:

means for advancing toner through said conduit to the developer unit, said developer unit being adapted to develop a latent image forming a developed image; and a pixel counter adapted to generate a signal as a function of the developed image density, said advancing means moving the toner through said conduit as a function of the signal from said pixel counter.

8. A development system adapted to develop a latent image recorded on an image receiving member including:

a housing defining a chamber having toner therein;

means for advancing the toner from the chamber to the image receiving member to develop the latent image recorded thereon;

a toner dispensing system comprising a stationarily mounted first toner discharge unit, connected to the chamber of said housing, to discharge toner into the chamber of said housing; and a stationarily mounted second toner discharge unit, connected to the chamber of said housing and being energized in response to said first toner discharge unit being substantially depleted of toner, to discharge toner into the chamber of said housing.

9. A development system according to claim 8, further including a sensor for detecting that said first toner discharge unit is substantially depleted of toner and generating a signal indicative thereof to energize said second toner discharge unit.

10. A development system according to claim 9, further including a third toner discharge unit adapted to replace said first toner discharge unit in response to the signal from said sensor, said first toner discharge unit being removed from being in operative communication with the chamber of said housing and being replaced by said third toner discharge unit.

11. A development system adapted to develop a latent image recorded on an image receiving member including:

a housing defining chamber having toner therein;

means for advancing the toner from the chamber to the image receiving member to develop the latent image recorded thereon;

a toner dispensing system comprising a first toner discharge unit, in communication with the chamber of said housing, to discharge toner into the chamber of said housing;

a second toner discharge unit, in communication with the chamber of said housing and being energized in response to said first toner discharge unit being substantially depleted of toner, to discharge toner into the chamber of said housing;

a sensor for detecting that said first toner discharge unit is substantially depleted of toner and generating a signal indicative thereof to energize said second toner discharge unit;

a third toner discharge unit adapted to replace said first toner discharge unit in response to the signal from said sensor, said first toner discharge unit being removed from being in operative communication with the chamber of said housing and being replaced by said third toner discharge unit; and a conduit connecting said first toner discharge unit and said second toner discharge unit to the chamber of said housing.

12. A development system according to claim 11, wherein said conduit includes:

a feed tube;

a first intake tube, connected to said feed tube, having said first toner discharge unit removably coupled thereto, said third toner discharge unit being coupled to said first intake tube in response to said first toner discharge unit being de-coupled therefrom; and a second intake tube, connected to said feed tube, having said second toner discharge unit removably coupled thereto.

13. A development system according to claim 12, wherein said sensor includes:

a first sensor mounted in said first intake tube to detect when said first toner discharge unit is substantially depleted of toner; and a second sensor mounted in said second intake tube to detect when said second toner discharge unit is substantially depleted of toner.

14. A development system according to claim 11, further including:

means for advancing toner through said conduit to the developer unit, said developer unit being adapted to develop a latent image forming a developed image; and a pixel counter adapted to generate a signal as a function of the developed image density, said advancing means moving the toner through said conduit as a function of the signal from said pixel counter.

15. A printing machine of the type having a developer unit adapted to develop a latent image recorded on an image receiving member with toner, wherein the improvement includes:

a stationarily mounted first toner discharge unit, connected to the developer unit to discharge toner into the developer unit; and a stationarily mounted second toner discharge unit, connected to the developer unit and being energized in response to said first discharge unit being substantially depleted of toner, to discharge toner into the developer unit.

16. A printing machine according to claim 15, further including a sensor for detecting that said first toner discharge unit is substantially depleted of toner and generating a signal indicative thereof to energize said second toner discharge unit.

17. A printing machine according to claim 16, further including a third toner discharge unit adapted to replace said first toner discharge unit in response to the signal from said sensor, said first toner discharge unit being removed from being in operative communication with the developer unit and being replaced by said third toner discharge unit.

18. A printing machine of the type having a developer unit adapted to develop a latent image recorded on an image receiving member with toner, wherein the improvement includes;

a first toner discharge unit, in communication with the developer unit to discharge toner into the developer unit;

a second toner discharge unit, in communication with the developer unit and being energized in response to said first toner discharge unit being substantially depleted of toner, to discharge toner into the developer unit;

a sensor for detecting that said first toner discharge unit is substantially depleted of toner and generating a signal indicative thereof for energize said second toner discharge unit;

a third toner discharge unit adapted to replace said first toner discharge unit in response to the signal from said sensor, said first toner discharge unit being removed from being in operative communication with the developer unit and being replaced by said third toner discharge unit; and a conduit connecting said first toner discharge unit and said second toner discharge unit to the developer unit.

19. A printing machine according to claim 18, wherein said conduit includes:

a feed tube;

a first intake tube, connected to said feed tube, having said first toner discharge unit removably coupled thereto, said third toner discharge unit being coupled to said first intake tube in response to said first toner discharge unit being de-coupled therefrom; and a second intake tube, connected to said feed tube, having said second toner discharge unit removably coupled thereto.

20. A printing machine according to claim 19, wherein said sensor includes:

a first sensor mounted in said first intake tube to detect when said first toner discharge unit is substantially depleted of toner; and a second sensor mounted in said second intake tube to detect when said second toner discharge unit is substantially depleted of toner.

21. A printing machine according to claim 18, further including:

means for advancing toner through said conduit to the developer unit; said developer unit being adapted to develop a latent image forming a developed image; and a pixel counter adapted to generate a signal as a function of the developed image density, said advancing means moving the toner through said conduit as a function of the signal from said pixel counter.

* * * * *